US010164377B2

(12) United States Patent
Zhang et al.

(10) Patent No.: US 10,164,377 B2
(45) Date of Patent: Dec. 25, 2018

(54) PLUG CONNECTOR AND ELECTRICAL CONNECTOR ASSEMBLY

(71) Applicants: Tyco Electronics (Shanghai) Co. Ltd., Shanghai (CN); Tyco Electronics Corporation, Berwyn, PA (US)

(72) Inventors: Hai-Jun Zhang, Shanghai (CN); Eric Kong, Shanghai (CN); Christopher Scott Hertzler, Carlisle, PA (US)

(73) Assignees: Tyco Electronics (Shanghai) Co. Ltd., Shanghai (CN); TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 14/610,887

(22) Filed: Jan. 30, 2015

(65) Prior Publication Data

US 2015/0147900 A1 May 28, 2015

Related U.S. Application Data

(63) Continuation of application No. PCT/IB2013/056066, filed on Jul. 24, 2013.

(30) Foreign Application Priority Data

Aug. 3, 2012 (CN) ..... 2012 2 0384011 U

(51) Int. Cl.

| | |
|---|---|
| ***H01R 13/64*** | (2006.01) |
| ***H01R 13/627*** | (2006.01) |
| ***H01R 13/645*** | (2006.01) |
| ***H01R 24/68*** | (2011.01) |

(52) U.S. Cl.

CPC ..... *H01R 13/64* (2013.01); *H01R 13/6271* (2013.01); *H01R 13/6272* (2013.01); *H01R 13/6456* (2013.01); *H01R 24/68* (2013.01)

(58) Field of Classification Search

CPC ..... H01R 13/6271; H01R 13/6272; H01R 12/7005; H01R 13/64; H01R 13/6273

USPC ..... 439/354, 353, 677, 680

See application file for complete search history.

(56) References Cited

U.S. PATENT DOCUMENTS

| | | | | |
|---|---|---|---|---|
| 4,781,626 A * | 11/1988 | Lazarchik | ..... | H01R 13/64 439/680 |
| 5,391,090 A * | 2/1995 | Power | ..... | H01R 13/6272 439/353 |
| 5,425,650 A | 6/1995 | Maeda | | |
| 6,287,016 B1 | 9/2001 | Weigel | | |
| 6,482,027 B2 * | 11/2002 | Ishii | ..... | H01R 12/79 439/354 |
| 7,033,205 B2 * | 4/2006 | Aihara | ..... | H01R 13/6456 439/378 |

(Continued)

OTHER PUBLICATIONS

PCT Notification Concerning Transmittal of International Preliminary Report on Patentability, International Application No. PCT/IB2013/056066, dated Feb. 12, 2015, 1 page.

(Continued)

*Primary Examiner* — Felix O Figueroa
(74) *Attorney, Agent, or Firm* — Barley Snyder

(57) ABSTRACT

A plug connector being insertable into a corresponding socket connector is provided. The plug connector includes a first housing, a lock, and a first insertion device. The first housing includes a plurality of first connection terminal receiving passageways, while the lock is integrally connected with the first housing. The first insertion device formed on the lock.

15 Claims, 7 Drawing Sheets

(56) References Cited

U.S. PATENT DOCUMENTS

| | | | | |
|---|---|---|---|---|
| 7,238,041 | B2 * | 7/2007 | Katsuma | H01R 13/6272 439/354 |
| 7,559,786 | B2 * | 7/2009 | Glaser | H01R 13/6272 439/354 |
| 2011/0097942 | A1 | 4/2011 | Dooley | |
| 2015/0140853 | A1 * | 5/2015 | Hashimoto | H01R 13/7032 439/354 |

OTHER PUBLICATIONS

PCT International Preliminary Report on Patentability, International Application No. PCT/IB2013/056066, dated Feb. 3, 2015, 5 pages.
PCT International Search Report and Written Opinion of the International Searching Authority, International Application No. PCT/IB2013/056066, dated Dec. 20, 2013, 7 pages.

* cited by examiner

PLUG CONNECTOR AND ELECTRICAL CONNECTOR ASSEMBLY

CROSS-REFERENCE TO RELATED APPLICATION

This application is a continuation of PCT International Application No.: PCT/IB2013/056066, filed Jul. 24, 2013, which claims priority under 35 U.S.C. § 119 to Chinese Patent Application 2012203840110, filed Aug. 3, 2012.

FIELD OF THE INVENTION

The invention relates to an electrical connector assembly and, more particularly, to an electrical connector assembly having plug and socket connectors.

BACKGROUND

Generally, a plug connector and a socket connector are each electrically connected to a plurality of conductive wires. In an electronic circuit, different groups of conductive wires are often electrically connected with each other by simply inserting the plug connector into the socket connector, or conductive wires are often electrically connected to a circuit board or other electrical apparatus by simply inserting the plug connector into the socket connector connected to the circuit board or other electrical apparatus.

In some situations, various signal and power lines may be simultaneously applied to a common type of plug and socket connectors. Accordingly, for ensuring that the various signal and power lines can be quickly and correctly connected, an error-proof function for insertion must be provided in order to prevent improper connection between the plug connector and the socket connector.

FIG. 1 shows a known plug connector 200 and a known socket connector 300. As shown in FIG. 1, the known plug connector 200 includes a first housing 201 made of an insulation material, a lock 202 provided on the outside of the first housing 201, and first connection members (not shown) fixed in the first housing 201 and electrically connected to a plurality of first conductive wires 203, respectively. The known socket connector 300 includes a second housing 301 made of an insulation material, a lock 302 provided on the outside of the second housing 301, and second connection members (not shown) fixed in the second housing 301 and electrically connected to a plurality of second conductive wires 303, respectively. The lock 202 has a connection portion (not shown) located inside the lock 202 and connected to the outside of the first housing 201, and the other portions of the lock 202 except for the connection portion is separated from the outside of the first housing 201 by a certain distance, and an activation portion 2021 inclined outward is provided on an upper outside surface of the lock 202.

An operator can hold the activation portion 2021 and partially insert the plug connector 200 into the socket connector 300, so that the first connection members of the plug connector 200 are electrically connected to the second connection members of the socket connector 300, respectively, and the first lock 202 is locked with the second lock 302. As a result, the first conductive wires 203 are electrically connected to the plurality of second conductive wires 303, respectively.

When separating the plug connector 200 from the socket connector 300, an operator can press the activation portion 2021 to release the first lock 202 from the second lock 302. At this time, the plug connector 200 can be pulled out of the socket connector 300.

In the plug connector 200, an insertion rib 204 is provided on the outside of the first housing 201 at each end of the first housing 201, and a corresponding rib receiving groove 304 is provided inside the second housing 301 of the socket connector 300 at each end of the second housing 301. When the plug connector 200 is inserted into the socket connector 300, the insertion rib 204 is inserted into the rib receiving groove 304. As a result, by selecting the location and number of the insertion rib and the rib receiving groove, for example, designing the insertion rib/the rib receiving groove on/in a left side, a right side or both sides of the first/second housings, it can prevent the plug connector from improper insertion into a socket connector that is not matched with the plug connector.

SUMMARY

The invention has been made to overcome or alleviate an aspect of the above mentioned disadvantages, among others.

Accordingly, a plug connector being insertable into a corresponding socket connector is provided. The plug connector includes a first housing, a lock, and a first insertion device. The first housing includes a plurality of first connection terminal receiving passageways, while the lock is integrally connected with the first housing. The first insertion device formed on the lock.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

Figure 1:
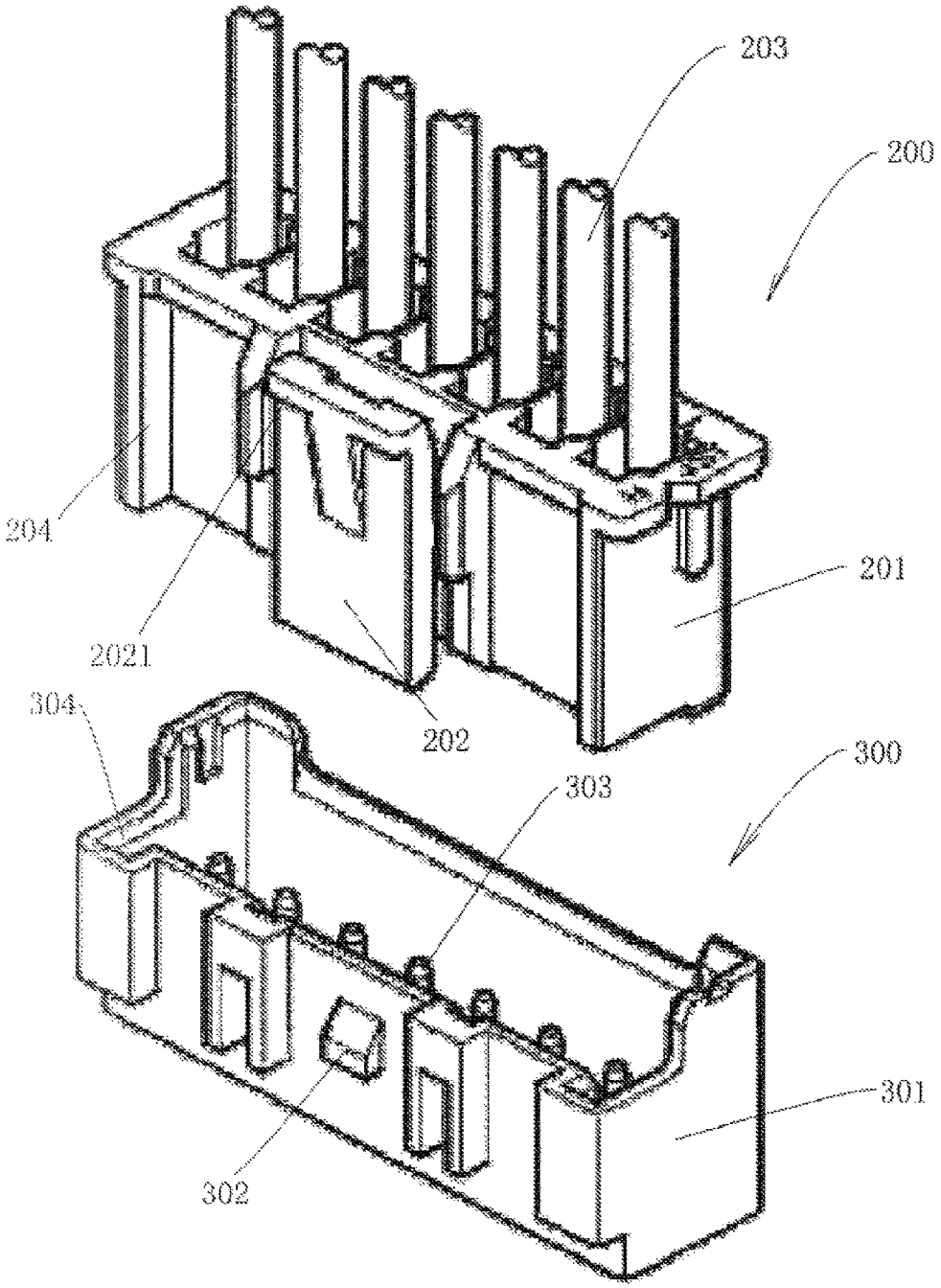
Fig. 1 PRIOR ART
FIG. 1 is an exploded perspective view of a known plug connector and a known socket connector in a prior art.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

A connector assembly according to various exemplary embodiments of the invention may be widely applied in an electronic circuit to achieve an electrical connection between different groups of conductive wires or between a group of conductive wires and a circuit board or other electronic apparatus.

Figure 2:
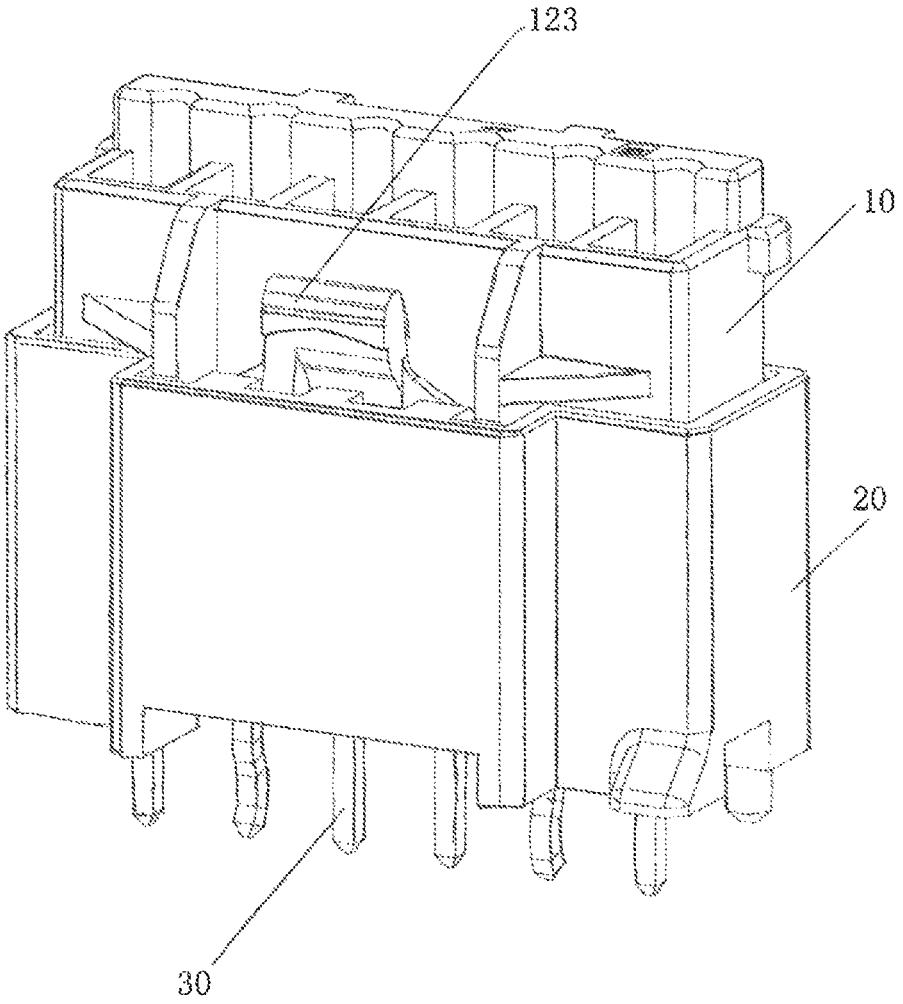
FIG. 2 is a perspective view of a connector assembly according to the invention.

Now with reference to FIGS. 2-4, a connector assembly according to the invention will be described. As shown, the connector assembly includes a plug connector 10 and a socket connector 20 mated with the plug connector 10.

Figure 3:
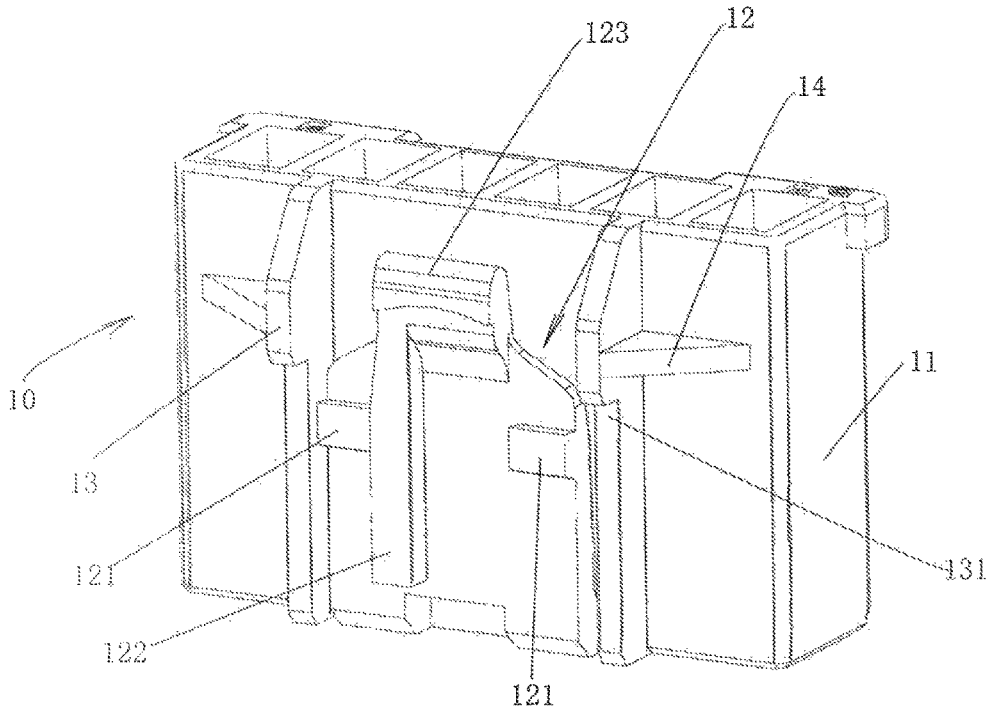
FIG. 3 is an exploded perspective view of the connector assembly of FIG. 2.
Figure 3:
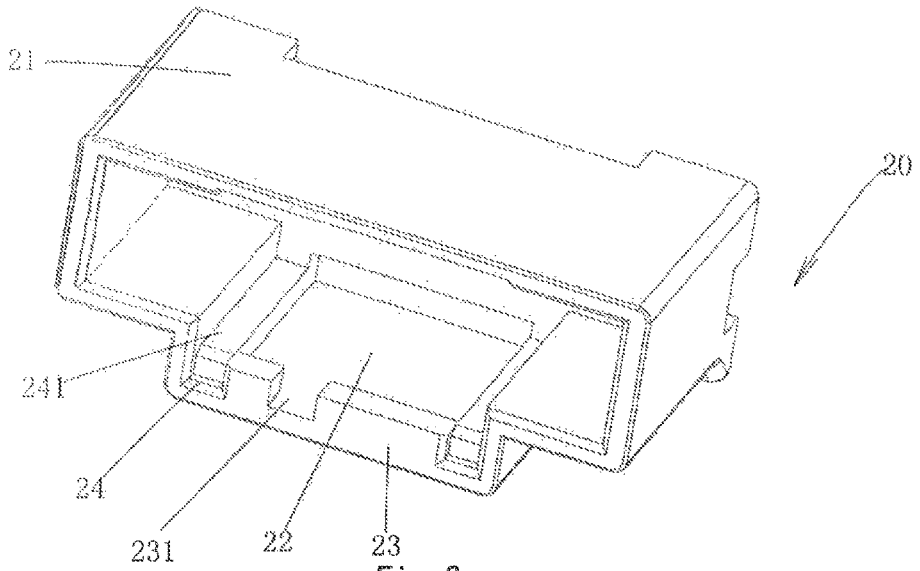

As shown in FIG. 3, the plug connector 10 includes a first housing 11 made of an insulation material and configured to receive a plurality of first connection terminals (not shown); a lock 12 integrally connected with the first housing 11 to lock the plug connector 10 to the socket connector 20; and a first insertion device formed on the lock 12 to be mated with a corresponding second insertion device of the socket connector 20.

As shown in FIG. 3, the socket connector 20 includes a second housing 21 configured to receive a plurality of second conductive wires or second connection terminals 400 connectable to a circuit board or other electronic apparatus; a receiving portion 22 formed on and partially protruded outward from a side of the second housing 21 to receive the lock 12 therein; and second insertion device configured to mate with the first insertion device.

In the plug connector 10 according to an exemplary embodiment of the present invention, an inner surface of the lock 12 is separated from an outside surface of the first housing 11, and the lock 12 is integrated with the first housing 11 at an insertion end of the plug connector 10. The lock 12 includes a locking protrusion 121 formed on an outside surface of the lock 12 and configured to be mated with the socket connector 20, so that the plug connector 10 is secured to the socket connector 20. The locking protrusion 121 is symmetrically disposed on the outside surface of the lock 12 about an axis extending in an insertion direction of the plug connector 10 through the center of the outside surface of the lock 12, as shown in FIGS. 3 and 4.

Further, the socket connector 20 further includes a block portion 23 laterally extending (in a direction perpendicular to an insertion direction of the plug connector 10) along an inner side of the receiving portion 22 and protruded inward, for example, from an edge of the receiving portion 22 at an entrance side of the socket connector 20. The block portion 23 is configured to be mated with the locking protrusion 121 to block the plug connector 10 from being disengaged from the socket connector 20.

Further, an activation portion 123 inclined outward is provided at one end (an upper end in FIG. 3) of the lock 12 opposite to the insertion end of the plug connector 10. As shown in FIGS. 3-4, when an operator presses the upper end of the lock 12 toward the outside surface of the first housing 11, the locking protrusion 121 of the lock 12 can get across the block portion 23, so that the plug connector 10 can be inserted into the socket connector 20, and at the same time, the lock 12 can be received in the receiving portion 22. After the plug connector 10 is inserted into the socket connector 20, the operator releases the press force from the activation portion 123, the lock 12 elastically expands outward, so that an upper surface of the locking protrusion 121 abuts against a lower surface of the block portion 23 to block the plug connector 10 from being disengaged from the socket connector 20. After the plug connector 10 has been mated with the socket connector 20, the activation portion 123 is exposed outside the second housing 21, for facilitating the operator to press the activation portion 123 to release the lock 12 and pull the plug connector 10 out of the socket connector 20.

In a further exemplary embodiment of the invention, the first insertion device may include an insertion protrusion 122 protruded from an outside surface of the lock 12. The insertion protrusion 122 extends in an up and down direction (that is, the insertion direction of the plug connector 10) and is disposed asymmetrically about an axis extending in the insertion direction through a center of the outside surface of the lock 12, as shown in FIG. 3. As shown in FIGS. 3 and 4, the locking protrusion 121 is disposed on each of two opposite sides of the insertion protrusion 121 in a direction perpendicular to the insertion direction. Correspondingly, the second insertion device includes a notch 231 formed along the block portion 23, the notch 231 is in correspondence to the insertion protrusion 122 to allow the insertion protrusion 122 to pass there through.

In a further exemplary embodiment of the invention, a reinforcing rib 13 is provided near at each of right and left sides of the lock 12 of the first housing 11, and the reinforcing rib 13 extends in a direction (the upper and down direction shown in FIGS. 3-4) in which the plug connector 10 is inserted. Correspondingly, two rib receiving passageways 24 are provided inside the second housing 21, the rib receiving passageways 24 are in correspondence to the reinforcing ribs 13 to allow the reinforcing ribs 13 to pass there through, respectively. The reinforcing ribs 13 can increase the strength of the first housing 11 to protect the lock 12 between the reinforcing ribs 13. Two projection receiving notches 131 are formed in the reinforcing ribs 13, respectively. Correspondingly, the second insertion device further includes two projections 241 provided in the two rib receiving passageways 24, respectively. The projections 241 are in correspondence to the projection receiving notches 131 to be mated with the rib receiving notches 131, respectively.

In the connector assembly according to the invention, the shape and the location of the insertion protrusion 122 of the plug connector 10 must be in correspondence to the shape and the location of the notch 231 of the socket connector 20, and the shape and the location of the projection receiving notches 131 of the plug connector 10 must be in correspondence to the shape and the location of the projection 241 of the socket connector 20, respectively, otherwise the plug connector 10 cannot be inserted into the socket connector 20. In this way, it can prevent the plug connector 10 from being inserted into an unmatched socket connector.

Figure 4:
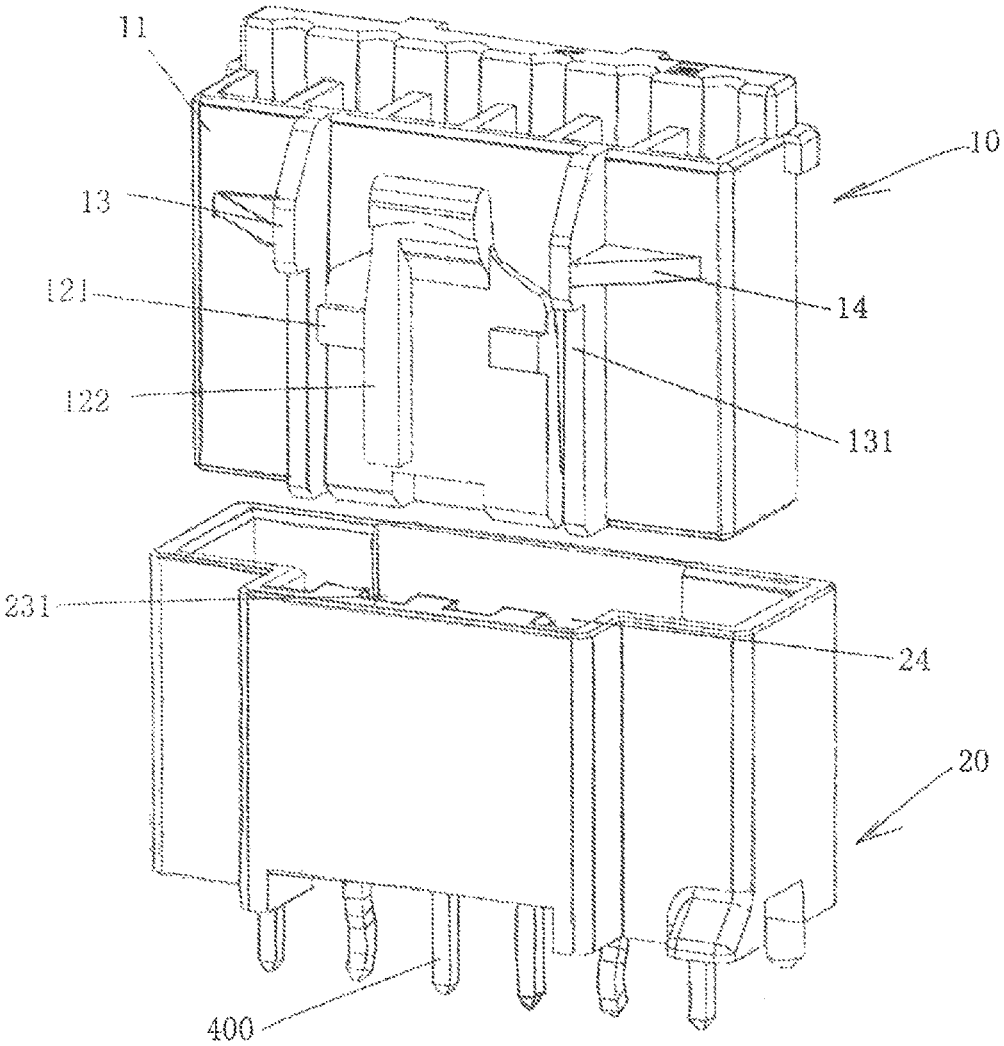
FIG. 4 is another exploded perspective view of the connector assembly of FIG. 2.

As shown in FIGS. 3-4, the plug connector 10 is further provided with a secondary reinforcing rib 14 connected to the outside surface of the first housing 11 and the reinforcing rib 13. The secondary reinforcing rib 14 can increase the strength of the reinforcing rib 13 and the first housing 11, and can prevent the plug connector 10 from being further inserted into the socket connector 20.

Figure 5:
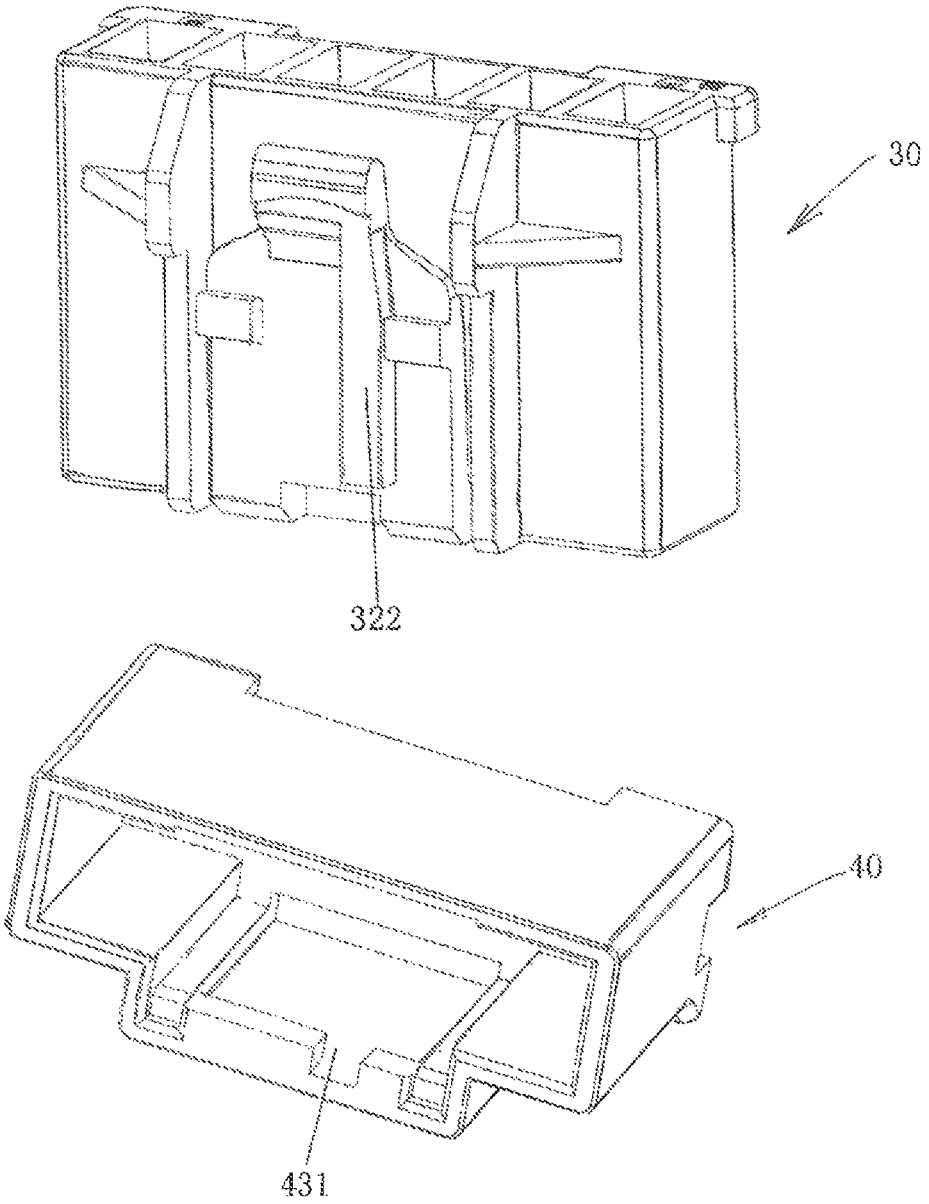
FIG. 5 is an exploded perspective view of another connector assembly according to the invention.

As shown in FIG. 5, an insertion protrusion 322 on a plug connector 30 and a corresponding notch 431 of a socket connector 40 are different from the location of the insertion protrusion 122 on the plug connector 10 and the location of the corresponding notch 231 in the socket connector 20. Since other parts of the connector assembly discussed above are substantially the same, a description of these parts is omitted herein for sake of brevity.

As shown in FIG. 5, the location of the insertion protrusion 322 on the plug connector 30 is in correspondence to the location of the notch 431 in the socket connector 40, so that the plug connector 30 can be inserted into the socket connector 40. However, the plug connector 10 of the first embodiment cannot be inserted into the socket connector 40 of the second embodiment.

Figure 6:
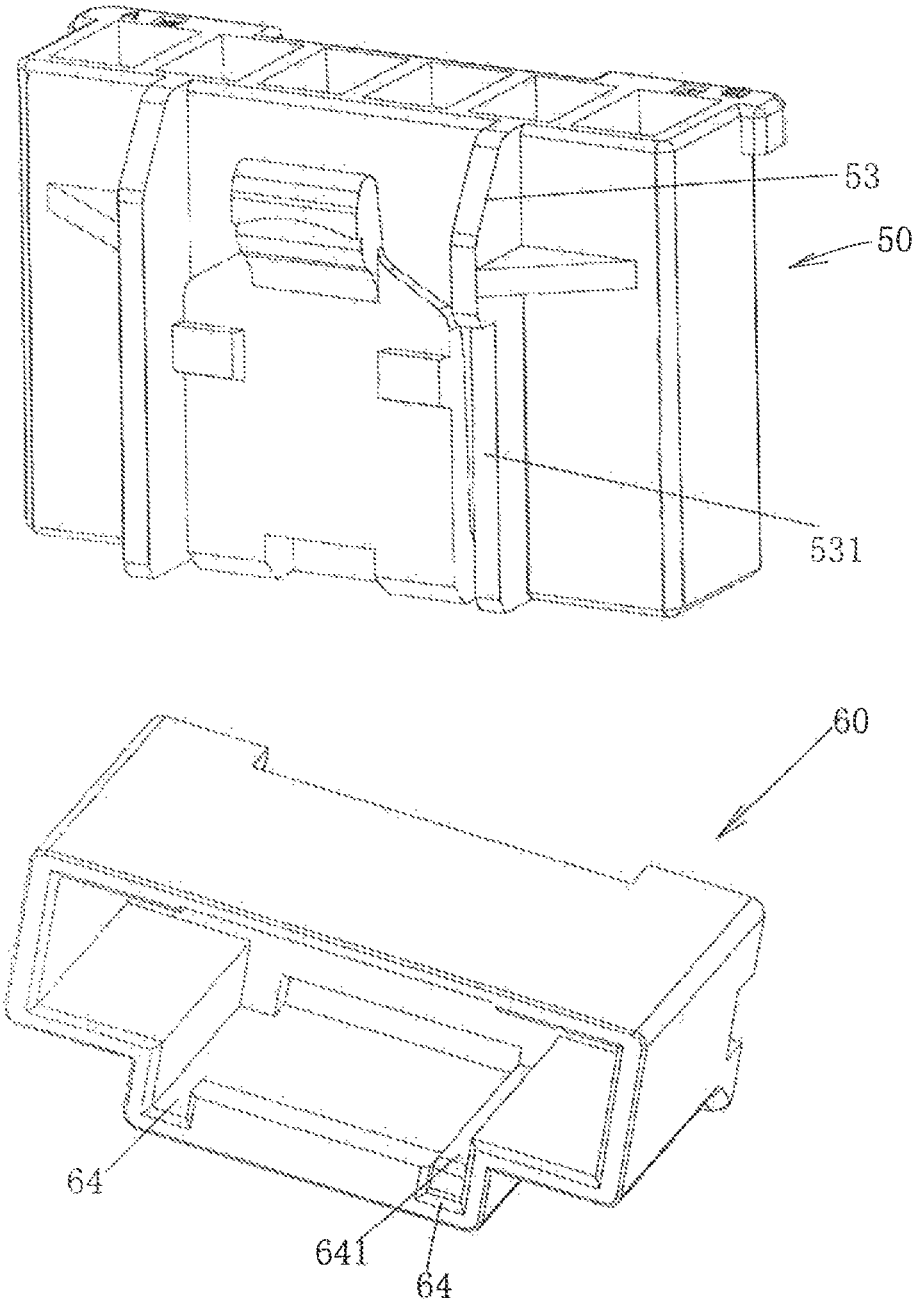
FIG. 6 is an exploded perspective view of another connector assembly according to the invention.

As shown in FIG. 6, with description to another embodiment of the invention, a notch 531 is formed along a reinforcing rib 53, at a right side of the plug connector 50, and a projection 641 is formed in a passageway 64 along a right side of the socket connector 60. As shown in FIG. 6, the plug connector 50 is not provided with an insertion protrusion, and the socket connector 60 is not provided with a notch. Since the embodiment shown in FIG. 6 is substantially the same as the embodiment shown in FIGS. 1-4, a description of like parts is omitted herein for sake of brevity. In the third embodiment, the notch 531 in the plug connector 50 is in correspondence to the projection 641 on the socket connector 60, so that the plug connector 50 can be inserted into the socket connector 60. However, the plug connector 10 of the first embodiment cannot be inserted into the socket connector 60 of the third embodiment.

Figure 7:
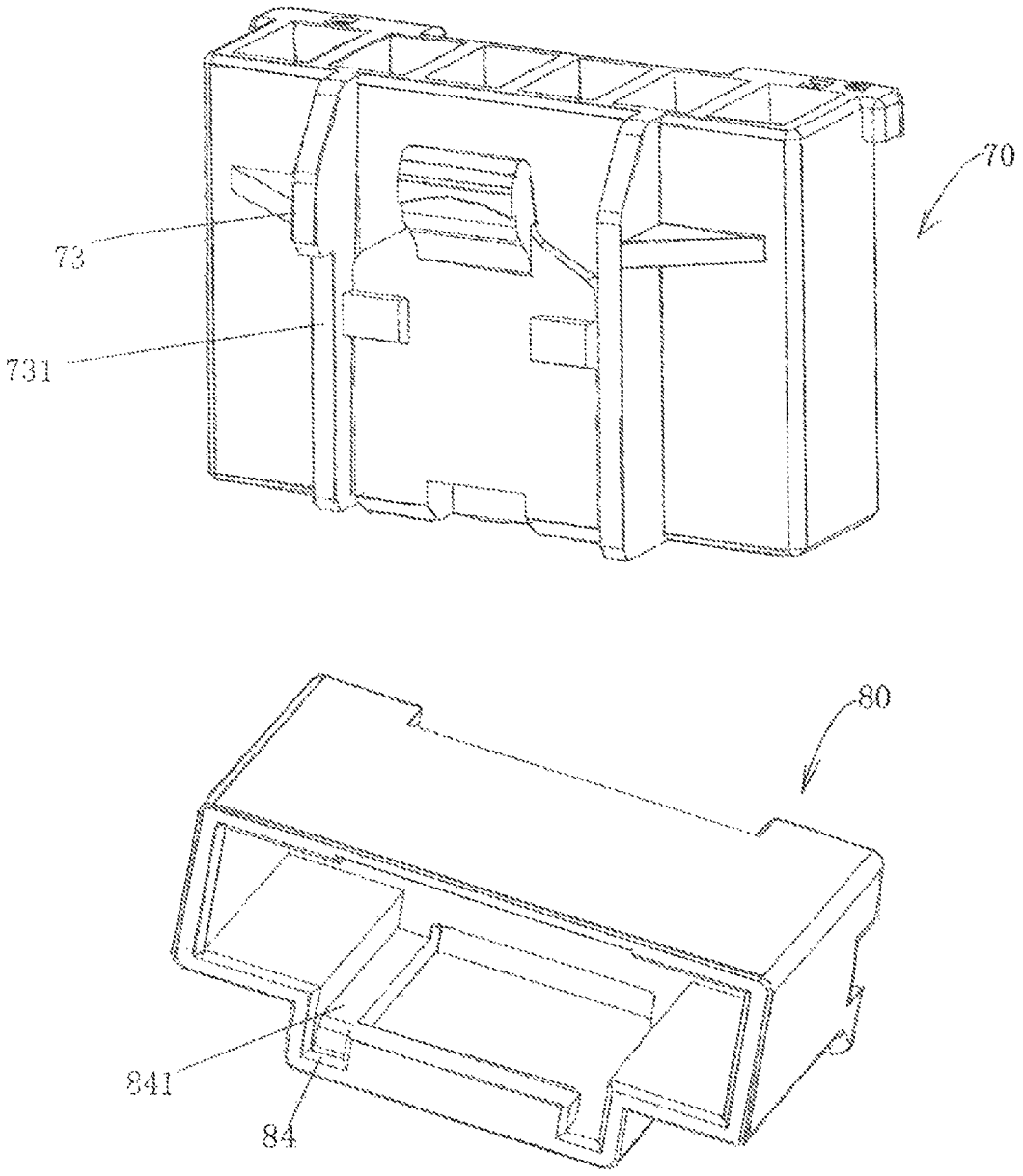
FIG. 7 is an exploded perspective view of another connector assembly according to the invention.

As shown in FIG. 7, with description to another embodiment of the invention, a notch 731 is formed along a reinforcing rib 73 at a left side of the plug connector 70, and a projection 841 is formed in a passage 84 along a left side of the socket connector 80. Since the embodiment shown in FIG. 7 is substantially the same as the embodiment shown in FIGS. 1-4, a description of like parts is omitted herein for sake of brevity. The notch 731 in the plug connector 70 is in correspondence to the projection 841 on the socket connector 80, so that the plug connector 70 can be inserted into the socket connector 80. However, the plug connector 50 of FIG. 6 cannot be inserted into the socket connector 80 of FIG. 7.

In the above various embodiments of the invention, the housing, the lock and the reinforcing rib of the plug connector may be formed into one piece, for example, by an injection molding. Also, the housing, the block portion, the passage and the projection of the socket connector may be formed into one piece, for example, by an injection molding. The first insertion device of the plug connector and the second insertion device of the socket connector form a pair of complementary structures. For example, the insertion protrusion of the first insertion device is configured to be a protrusion structure, and the notch of the second insertion device is configured to be a recess structure complementary to the protrusion structure. Furthermore, for example, the notch of the reinforcing rib of the first insertion device is configured to be a recess structure, and the projection in the passage of the second insertion device is configured to be a protrusion structure complementary to the recess structure. That is, the protrusion structure indicates that a material the same as the housing is present and the recess structure indicates that no material is present.

Given that, in a direction from left side to right side as shown in FIGS. 3-7, as for the plug connector (for example, the plug connector 10 of FIGS. 1-4), a feature of the notch (for example, the rib receiving notch 131) , where no material is present, in the reinforcing rib is indicated as "0", a feature of the insertion protrusion (for example, the insertion protrusion 122), where the material is present, of the lock is indicated as "1"; also, as for the socket connector (for example, the socket connector 20 of FIGS. 1-4), a feature of the projection (for example, the projection 241), where the material is present, in the passage is indicated as "1", and a feature of the notch (for example, the notch 231), where no material is present, in the block portion (for example, the block portion 23) is indicated as "0", then, a table showing the pair of complementary features of the plug and socket connectors can be obtained as follows:

| | | Feature 1 | Feature 2 | Feature 3 | Feature 4 |
|---|---|---|---|---|---|
| FIGS. 1-4 | The plug connector | 0 | 1 | 0 | 0 |
| | The socket connector | 1 | 0 | 1 | 1 |
| FIG. 5 | The plug connector | 0 | 0 | 1 | 0 |
| | The socket connector | 1 | 1 | 0 | 1 |
| FIG. 6 | The plug connector | 1 | 0 | 0 | 0 |
| | The socket connector | 0 | 1 | 1 | 1 |
| FIG. 7 | The plug connector | 0 | 0 | 0 | 1 |
| | The socket connector | 1 | 1 | 1 | 0 |

It is to be understood for those skilled in this art that the above examples of mating the plug connector with the socket connector by means of the first and second insertion devices are intended to be illustrative, and not restrictive. Many modifications of the plug and socket connectors to be mated with each other can be made by changing the number, location and shape of the notch and the insertion protrusion of the first insertion device of the plug connector and correspondingly changing the number, location and shape of the projection and the notch of the second insertion device of the socket connector. In this way, many modifications of the connector assembly having different error-proof insertion structures can be made. That is, a series of connector assembly products can be obtained. In the series of connector assembly products, only when the error-proof insertion features of the plug connector is matched with the error-proof insertion features of the socket connector, the plug connector can be inserted into the socket connector. Thereby, it can prevent inserting the plug connector into an unmatched socket connector, avoiding connecting unmatched conductive wires together or connecting conductive wires to incorrect positions of the circuit board or other electronic apparatus.

Furthermore, in the above various embodiments of the present invention, all the error-proof insertion structures are formed on the housings of the plug and socket connectors, therefore, other error-proof key insertion structures and additional materials forming these key structures are omitted, thereby reducing the dimension of the housings, and facilitating the insertion of the plug connector into the socket connector.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle, so that more kinds of electrical connector assemblies can be achieved with overcoming the technical problem of the present invention.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "a" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A plug connector, comprising:

a first housing having a plurality of first connection terminal receiving passageways;

a lock integrally connected with the first housing and elastically deflectable with respect to the first housing;

an insertion protrusion disposed on an outside surface of the lock and extending along an insertion direction of the plug connector, the insertion protrusion disposed off-centered on the outside surface of the lock from a center of the outside surface of the lock in a direction perpendicular to the insertion direction and the insertion protrusion disposed asymmetrically about an axis extending in the insertion direction through the center of the outside surface of the lock, the plug connector including only one lock and only one insertion protrusion;

a locking protrusion symmetrically disposed on the outside surface of the lock about the axis extending in the insertion direction through the center of the outside surface of the lock, the locking protrusion disposed on each of two opposite sides of the insertion protrusion in the direction perpendicular to the insertion direction; and a pair of reinforcing ribs each disposed along an edge of the lock.

2. The plug connector according to claim 1, wherein each reinforcing rib extends from a leading end of the first housing to a distal end of the first housing.

3. The plug connector according to claim 2, wherein each reinforcing rib includes a projection receiving notch extending along a top surface thereof.

4. The plug connector according to claim 1, wherein the lock includes a proximal end attached to the first housing and a free end spaced from an outer surface of the first housing.

5. The plug connector according to claim 4, further comprising an activation portion connected to and inclined outward from the free end.

6. An electrical connector assembly, comprising:

a plug connector having:

a first housing having a plurality of first connection terminal receiving passageways;

a lock integrally connected with the first housing and elastically deflectable with respect to the first housing;

an insertion protrusion disposed on an outside surface of the lock and extending along an insertion direction of the plug connector, the insertion protrusion disposed off-centered on the outside surface of the lock from a center of the outside surface of the lock in a direction perpendicular to the insertion direction and the insertion protrusion disposed asymmetrically about an axis extending in the insertion direction through the center of the outside surface of the lock, the plug connector including only one lock and only one insertion protrusion;

a locking protrusion symmetrically disposed on the outside surface of the lock about the axis extending in the insertion direction through the center of the outside surface of the lock, the locking protrusion disposed on each of two opposite sides of the insertion protrusion in the direction perpendicular to the insertion direction; and a reinforcing rib disposed along an edge of the lock; and a socket connector having:

a second housing having a plurality of second connection terminal receiving passageways;

a lock receiving portion formed on and protruding outward from a side of the second housing, the locking protrusion secured within the lock receiving portion; and a notch corresponding with the insertion protrusion.

7. The electrical connector assembly according to claim 6, wherein the socket connector includes a block portion laterally extending from an inner side of the lock receiving portion and protruded inward therefrom.

8. The electrical connector assembly according to claim 7, wherein the block portion corresponds with the locking protrusion.

9. The electrical connector assembly according to claim 8, wherein the notch is formed in the block portion in receiving correspondence with the insertion protrusion.

10. The electrical connector assembly according to claim 6, wherein the reinforcing rib extends from a leading end of the first housing to a distal end of the first housing.

11. The electrical connector assembly according to claim 10, wherein the reinforcing rib includes a projection receiving notch extending along a top surface thereof.

12. The electrical connector assembly according to claim 11, further comprising a rib receiving passageway provided along an inner side of the second housing and in receiving correspondence with the reinforcing rib.

13. The electrical connector assembly according to claim 12, further comprising a projection provided in the rib receiving passageway and in receiving correspondence with the projection receiving notch.

14. The electrical connector assembly according to claim 6, wherein the lock includes a proximal end attached to the first housing and a free end spaced from an outer surface of the first housing.

15. The electrical connector assembly according to claim 14, further comprising an activation portion connected to and inclined outward from the free end.

* * * * *